United States Patent [19]

Söderlund et al.

[11] Patent Number: 4,946,362

[45] Date of Patent: Aug. 7, 1990

[54] ROTARY SCREW COMPRESSOR WITH A LIFT VALVE MOUNTED IN HIGH PRESSURE END WALL

[75] Inventors: Frits Söderlund, Saltsjöbaden; Sören Edström, Uppsala, both of Sweden

[73] Assignee: Svenska Rotor Maskiner AB, Stockholm, Sweden

[21] Appl. No.: 336,212

[22] Filed: Apr. 11, 1989

[30] Foreign Application Priority Data

Apr. 25, 1988 [SE] Sweden ..... 8801525

[51] Int. Cl.[5] ..... F04C 18/16; F04C 29/08

[52] U.S. Cl. ..... 418/201.2; 418/270; 417/441

[58] Field of Search ..... 418/201, 270, 159; 417/440, 441

[56] References Cited

U.S. PATENT DOCUMENTS 4,435,139 3/1984 Astberg ..... 418/201

4,737,082 4/1988 Glanvall ..... 418/159

FOREIGN PATENT DOCUMENTS 8600427.2 1/1986 Sweden .

*Primary Examiner*—John J. Vrablik

*Assistant Examiner*—David L. Cavanaugh

*Attorney, Agent, or Firm*—Frishauf, Holtz, Goodman & Woodward

[57] ABSTRACT

A rotary screw compressor with a lift valve comprising a valve member having two rigidly connected cylindrical sections of different diameter. The valve member is displaceably mounted in a valve housing extending through the high pressure end wall of the compressor. The valve housing sealingly surrounds each of the cylindrical sections. The section of the smaller diameter and the corresponding part of the valve housing face the working space of the machine. The lift valve is mounted such that the direction of motion of the valve member is inclined relative to the axial direction of the compressor.

4 Claims, 2 Drawing Sheets

ROTARY SCREW COMPRESSOR WITH A LIFT VALVE MOUNTED IN HIGH PRESSURE END WALL

BACKGROUND OF THE INVENTION

The present invention pertains to a rotary screw compressor with a lift valve mounted in the high pressure end wall of the compressor, said lift valve comprising a valve member having two rigidly connected cylindrical sections of different diameter displaceably mounted in a valve housing, said valve housing sealingly surrounding each of said sections, the section of the smaller diameter and the corresponding part of the valve housing facing the working space of the machine.

A machine of the rotary screw type in question comprises two rotors mounted in a working space, which is limited by two end walls and a barrel wall extending therebetween. The barrel wall has the shape of two intersecting cylinders, each housing one of the rotors. Each rotor is provided with helically extending lobes and grooves, being in intermesh to form chevron-shaped compression chambers. In these chambers a gaseous fluid is displaced and compressed from an inlet channel to an outlet channel. Each compression chamber during a filling phase communicates with the inlet, during a compression phase undergoes a continuous reduction in volume and during a discharge phase communicates with the outlet. Reference is made U.S. Pat. No. 4,435,139 disclosing an example of this general type of compressor.

Machines of this kind often are provided with valve means for regulating the built-in volume ratio ($V_i$) or the capacity or for other purposes. When continuous regulation is required, usually slide valves are used, whereas at simpler regulation needs it might be sufficient to use lift valves. Such a valve is mounted in the barrel wall of the machine or in one of the end walls, normally the high pressure end wall.

In known rotary screw compressors having a lift valve in one of the end walls, the lift valves are axially directed. This, however, in some cases can cause a problem to attain space enough for the lift valve, as the end wall section also has to house bearings and seals for the shafts of the rotors. The object of the present invention therefore is to construct the valve in a rotary screw compressor of the discussed above, specified kind in such a way that said problem is overcome.

SUMMARY OF THE INVENTION

According to the invention this has been achieved by mounting the lift valve such that the direction of motion of the valve member is inclined relative to the axial direction of the compressor.

When the lift valve in this way is obliquely directed in the end wall, a better possibility to find sufficient space for the valve is attained since it will not interfere with the bearings and seals.

When so mounted the orifice of the valve boring in the inner surface of the end wall will be elliptically shaped. Correspondingly the end surface of the valve member facing the working space has to be inclined relative to a plane perpendicular to the axial direction of the valve. Therefore, the valve member must be in a determined angular position to attain alignment of the end surface of the valve member and the inner surface of the end wall, why some kind of guiding means is required to assure a correct angular position of the valve member.

In Swedish patent application No. 8600427-2 a lift valve mounted in the barrel wall of the machine is disclosed.

In FIG. 6 of that Swedish application (reproduced as FIG. 3 of the present application) it can be seen how the valve member is guided to the correct angular position by means of a guiding pin 18, whereby the surface of the valve member facing the working space will be so positioned that its direction of curvature coincides with that of the inner surface of the barrel wall.

The provision of special guiding means for assuring a correct angular position of the valve member makes the valve construction more complicated which increases the manufacturing costs.

According to a preferred embodiment of the invention the need for special angular guiding means is eliminated in that the two cylindrical sections of the valve member are eccentric relative to each other.

The reason why a valve member of this kind has two sections of different diameter is, that by making the outer section of the valve member with a larger diameter, a larger area for the actuating pressure is achieved. The exertted force thereby will be sufficient to keep the valve closed when this is required. By making this section eccentric relative to the other one it is attained that the angular position of the valve member will be fixed without requiring any special guiding means. The section of the valve member having the larger diameter thus exerts a dual function according to the invention: to attain a sufficient pressure area and to guide the valve member to a correct angular position.

The elimination of special guiding means makes the manufacture more economical and the valve requires less space.

The invention will be further explained through the following detailed description of preferred embodiments thereof and with reference to the accompanying drawings.

DETAILED DESCRIPTION

Figure 1:
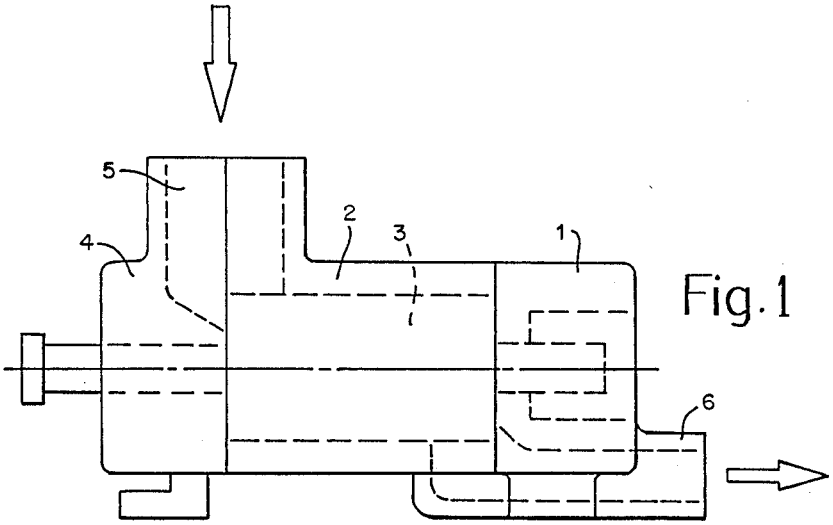
FIG. 1 schematically shows a rotary screw compressor.

FIG. 1 schematically shows the structure of a rotary screw compressor of the kind to which the invention relates. The compressor has a casing, comprising a low pressure end wall 4, a high pressure end wall 1 and a barrel wall 2 extending therebetween. The casing encloses a working space, in which a pair of intermeshing rotors 3 are rotatable, whereby fluid is sucked from the inlet channel 5 and is compressed and transported in chevron-shaped compression chambers to the outlet channel 6.

Such a compressor should be so dimensioned that the pressure in a compression chamber at the moment of its opening towards the outlet channel equals the pressure in the outlet channel. The pressure in the outlet channel, however, can change. If this pressure is lower than the pressure for which the compressor is made, the working fluid will be overcompressed, resulting in a decrease in efficiency. By providing a valve, which can bring a compression chamber into communication with the outlet channel 6 at an earlier moment than through the fixed outlet port, the built-in volume ratio of the compressor can be lowered so that the end pressure in the compressor becomes adapted to the lower pressure in the outlet channel 6. In order to adapt the compressor to variations in the demand of compressed fluid, it is possible also to provide it with valve means for regulating the capacity. A capacity valve in the open position connects a closed compression chamber to the inlet of the compressor, whereby a lower capacity is received.

Figure 2:
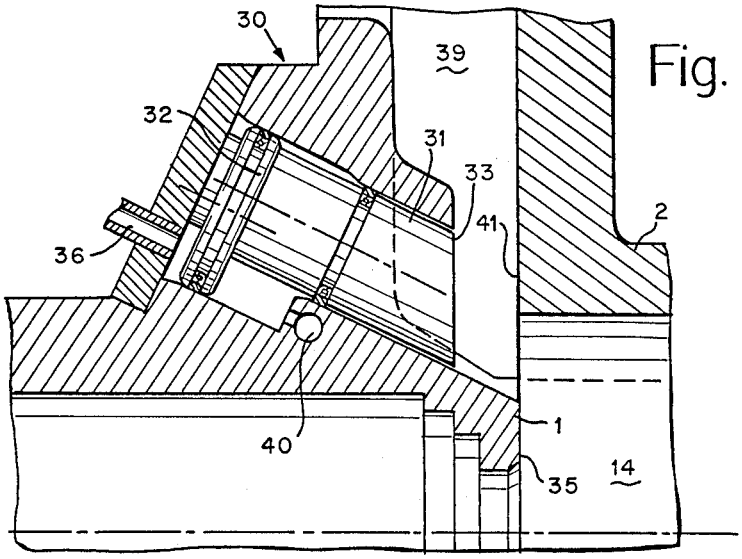
FIG. 2 is a fragmentary section of a rotary screw compressor having a lift valve according to a first embodiment of the invention.
Figure 3:
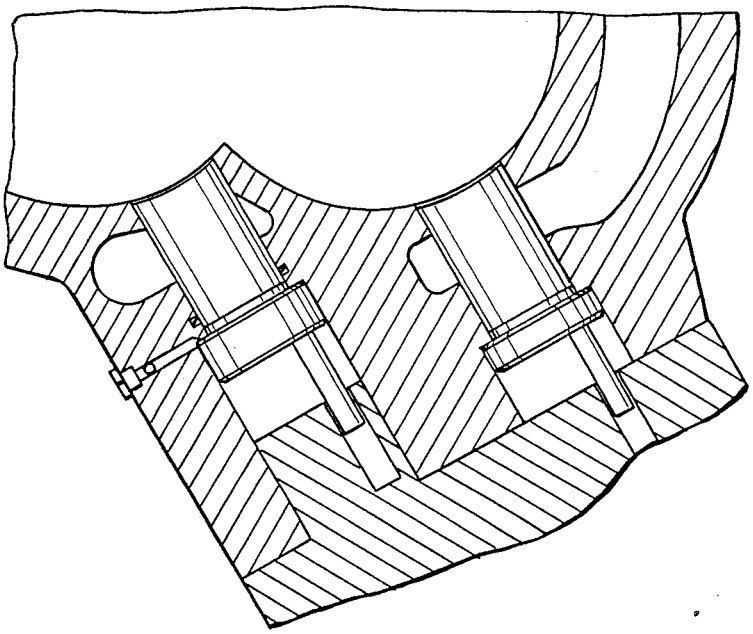
Fig. 3 (PRIOR ART)
FIG. 3 shows a prior art lift valve.

In the embodiment shown in FIG. 2 the valve is mounted in the high pressure end wall 1 of the compressor for regulating the built-in volume ratio thereof. The valve member, comprising two cylindrical sections 31, 32 of different diameter rigidly connected to each other, is displaceably mounted in a valve housing 30, which sealingly surrounds each of the valve member sections 31, 32. The direction of motion of the valve member 31, 32 is inclined relative to the axial direction of the compressor. In the figure the valve is shown in its open position allowing compressed working fluid to start to flow from the working space 14 to the outlet channel 39 at an earlier stage than when discharged through the fixed outlet port. The valve is kept in this position by admitting high pressure fluid to the right side, as seen in the figure, of the larger section 32 of the valve member by means of a channel 40 which can be connected to the outlet channel of the compressor. The left side of the larger section 32 in this position is connected to the inlet channel of the compressor by means of a channel 36.

If the valve is to be moved to its closed position in response to a signal calling for a higher built-in volume ratio, the channel 40 is connected to the inlet channel of the compressor and the channel 36 to the outlet channel thereof. As a result thereof, the valve member 31, 32 moves rightwards until the surface 33 of the smaller section 31 of the valve member reaches the wall 41. In this position the surface 33 will be coplanar with the inner surface 35 of the end wall 1. The two sections 31, 32 are eccentric relative each other, whereby the angular position of the valve member is fixed. In this way the surface 33 is secured to align with the inner surface 35 of the end wall 1.

We claim:

1. A rotary screw compressor comprising:

means defining a working space in which two rotors are rotatably mounted;

a high pressure end wall at one end of said working space;

a low pressure end wall at the other end of said working space; and a lift valve mounted in said high pressure end wall of the compressor;

said lift valve comprising:

a valve member having two rigidly connectted cylindrical sections of different diameter displaceably mounted in a valve housing, said valve housing sealingly surrounding each of said sections of said valve member, said section of said valve member having the smaller diameter and the corresponding part of the valve housing facing the working space of the compressor; and said lift valve being mounted such that a direction of motion of said displaceable valve member, relative to said high pressure wall, is inclined relative to the axial direction of the compressor.

2. The rotary screw compressor according to claim 1, wherein said two cylindrical sections of said valve member are eccentric relative to each other.

3. The rotary screw compressor according to claim 2, wherein the angular position of said lift valve, relative to said axial direction, is fixed.

4. The rotary screw compressor according to claim 1, wherein said smaller diameter section of said valve member has an elliptically shaped end surface which faces the working space of the compressor.

* * * * *

UNITED STATES PATENT AND TRADEMARK OFFICE

CERTIFICATE OF CORRECTION

PATENT NO. : 4,946,362

DATED : August 7, 1990

INVENTOR(S) : SÖDERLUND et al

It is certified that error appears in the above-identified patent and that said Letters Patent is hereby corrected as shown below:

Column 1, line 48, change "discussed above, specified kind" to --specified kind discussed above,--.

Column 1, line 68 (last line), change "wall, why" to --wall. This is why--.

Column 2, line 9, delete "18".

Column 2, line 25, change "exertted" to --exerted--.

Signed and Sealed this

Fourth Day of August, 1992

*Attest:*

DOUGLAS B. COMER

*Attesting Officer*

*Acting Commissioner of Patents and Trademarks*